US005908254A

United States Patent [19]

Anderson

[11] Patent Number: 5,908,254

[45] Date of Patent: Jun. 1, 1999

[54] CLUB MATE APPARATUS

[76] Inventor: Thomas M. Anderson, 541 S. San Marcos, San Dimas, Calif. 91773

[21] Appl. No.: 09/084,332

[22] Filed: May 26, 1998

[51] Int. Cl.[6] ..... A46B 11/00

[52] U.S. Cl. ..... 401/126; 401/129; 401/191

[58] Field of Search ..... 401/126, 129, 401/130, 191

[56] References Cited

U.S. PATENT DOCUMENTS 1,238,830 9/1917 Schuster et al. ..... 401/129

2,992,755 7/1961 Goldschmidt ..... 401/129 X

*Primary Examiner*—Steven A. Bratlie

[57] ABSTRACT

A club mate apparatus including a container that has a bottom wall, a top edge and a peripheral wall. The top edge has an eyelet integral therewith. A top wall has an opening therethrough. A pair of resilient clamps are attached to the top wall of the container. A brush member is included and has an elongated handle and a head portion with a bristle arrangement. A ridge disk member is integral the handle and spaced from a handle end. Finally, a ring seal is positioned around the disk member.

7 Claims, 2 Drawing Sheets

CLUB MATE APPARATUS

BACKGROUND OF THE INVENTION

1. Field of the Invention

The present invention relates to a club mate apparatus and more particularly pertains to providing a portable container and brush for cleaning a golf club at the playing site.

2. Description of the Prior Art

The use of a golf club cleaning device is known in the prior art. More specifically, golf club cleaning devices heretofore devised and utilized for the purpose of cleaning golf clubs are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,230,117 to Johnson and Johnson discloses a golf shoe and golf club cleaning device. U.S. Pat. No. 4,945,596 to Chang, Urbantas and Urbantas discloses a golf ball, golf club and golf shoe scrubber. U.S. Pat. No. 4,832,338 to Magazzi discloses a multipurpose golf game utensil. U.S. Pat. No. 4,464,072 to Norwell discloses a cleaning device for golf clubs. U.S. Pat. No. 4,350,457 to Carnahan discloses a golfball washer and club cleaner. Lastly, U.S. Pat. No. Des. 342,832 to Wabnitz discloses a golf club face cleaning tool.

In this respect, the club mate apparatus according to the present invention substantially departs from the conventional concepts and designs of the prior art, and in so doing provides an apparatus primarily developed for the purpose of providing a portable container and brush for cleaning a golf club at the playing site.

Therefore, it can be appreciated that there exists a continuing need for a new and improved club mate apparatus which can be used for providing a portable container and brush for cleaning a golf club at the playing site. In this regard, the present invention substantially fulfills this need.

SUMMARY OF THE INVENTION

In view of the foregoing disadvantages inherent in the known types of golf club cleaning devices now present in the prior art, the present invention provides an improved club mate apparatus. As such, the general purpose of the present invention, which will be described subsequently in greater detail, is to provide a new and improved club mate apparatus which has all the advantages of the prior art and none of the disadvantages.

To attain this, the present invention essentially comprises a generally cylindrical container. The container has a bottom wall, a top edge and a peripheral wall. A top wall is spaced from the top edge. The top wall has an opening therethrough for limiting the accessability to an interior portion of the container. Also, included is a pair of resilient clamps. Each clamp is attached to the top wall of the container. Each clamp is symmetrically placed near the opening of the container.

A brush member is provided. The brush member has an elongated handle and a head portion. The head portion is linearly aligned with the handle. A bristle arrangement is included and extends outwardly from the head portion of the brush member. The head portion, with the bristle arrangement, is sized for placement through the opening of the container. A ridge disk member is formed integral the handle and spaced from a handle end. The disk member projects outwardly from the handle. The disk member has a peripheral end.

Finally, a ring seal is positioned around the disk member. The disk member is sized for closing the opening of the container when the brush member is positioned within the container. The ring seal allows the disk member, within the opening, to provide the container with a waterproof seal when the a pair of resilient clamps lockingly engage the disk member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved club mate apparatus which has all the advantages of the prior art golf club cleaning devices and none of the disadvantages.

It is another object of the present invention to provide a new and improved club mate apparatus which may be easily and efficiently manufactured and marketed.

It is a further object of the present invention to provide a new and improved club mate apparatus which is of a durable and reliable construction.

An even further object of the present invention is to provide a new and improved club mate apparatus which is susceptible of a low cost of manufacture with regard to both materials and labor, and which accordingly is then susceptible of low prices of sale to the consuming public, thereby making such club mate apparatus economically available to the buying public.

Still yet another object of the present invention is to provide a new and improved club mate apparatus which provides in the apparatuses and methods of the prior art some of the advantages thereof, while simultaneously overcoming some of the disadvantages normally associated therewith.

Still another object of the present invention is to providing a portable container and brush for cleaning a golf club at the playing site.

Lastly, it is an object of the present invention to provide a new and improved a container that has a bottom wall, a top edge and a peripheral wall. The top edge has an eyelet integral therewith. A top wall has an opening therethrough. A pair of resilient clamps are attached to the top wall of the container. A brush member is included and has an elongated handle and a head portion with a bristle arrangement. A ridge disk member is integral the handle and spaced from a handle end. Finally, a ring seal is positioned around the disk member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
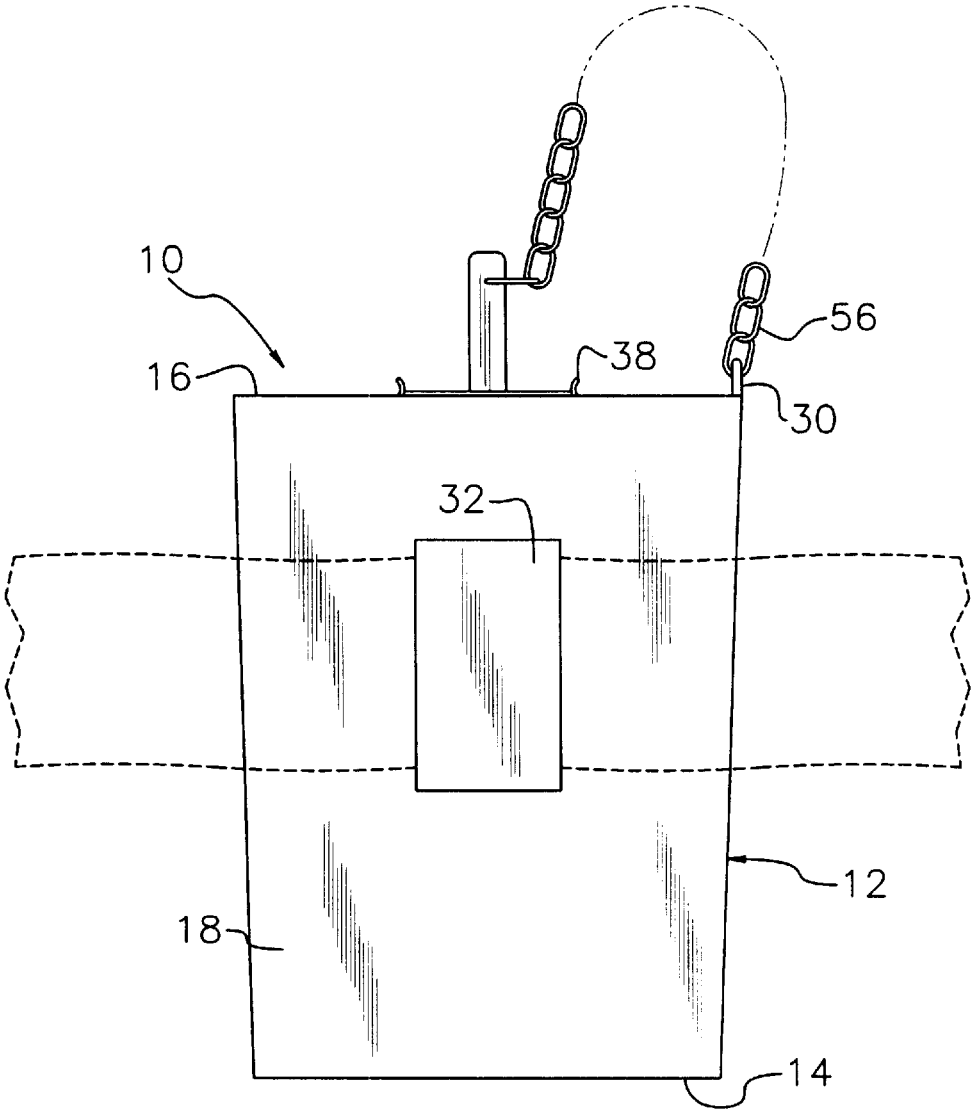
FIG. 1 is a frontal view of the preferred embodiment of the club mate apparatus constructed in accordance with the principles of the present invention.

With reference now to the drawings, and in particular to FIG. 1 thereof, a new and improved club mate apparatus embodying the principles and concepts of the present invention and generally designated by the reference numeral 10 will be described.

The present invention, the new and improved club mate apparatus, is comprised of a plurality of components. Such components in their broadest context include a container and a brush member. Such components are individually configured and correlated with respect to each other so as to attain the desired objective.

Figure 3:
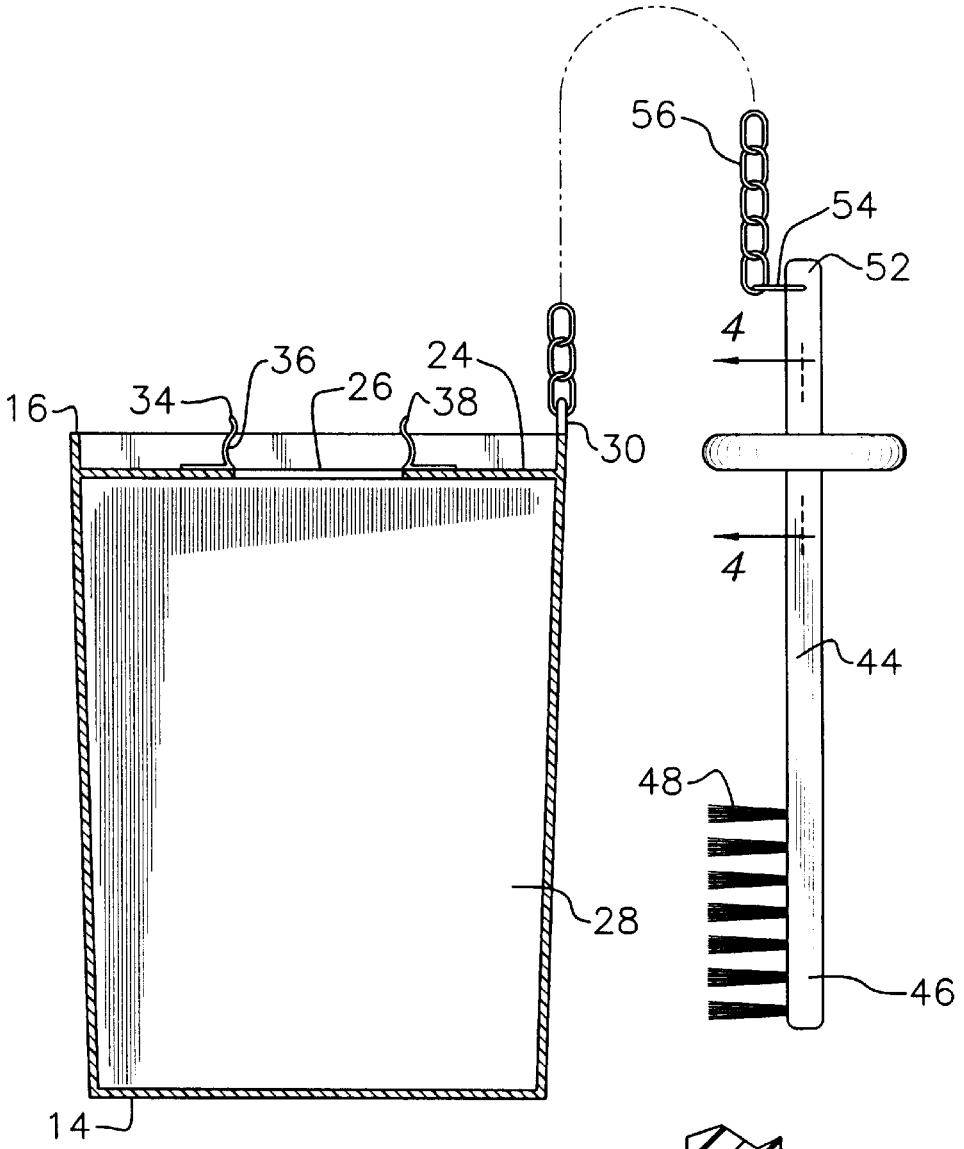
FIG. 3 is a cross-sectional view of the container of the present invention.

More specifically, the present invention includes a generally cylindrical container 12. The container is formed of a light weight plastic that is durable. The container has a bottom wall 14, a top edge 16 and a peripheral wall 18. As illustrated in FIG. 3, a top wall 24 is spaced from the top edge. The top wall has an opening 26. The opening limits the accessability to an interior portion 28 of the container. The top edge has an eyelet 30 integral therewith. The container is capable of carrying a golf club cleaning solution.

Also, a belt holder 32 is attached to the peripheral wall of the container. As shown in FIG. 1, the belt holder is structured to accommodate a trouser belt or a strap of the golf club bag.

Additionally, included are a pair of resilient clamps 34. As shown in FIG. 3, each clamp is attached to the top wall 24 of the container. Each clamp is symmetrically placed near the opening of the container. Each clamp has a concave portion 36 and a release edge 38. The release edge of each clamp is engaged by the golf players fingers to move each clamp back and forth.

A brush member 42 is provided. The brush member has an elongated handle 44 and a head portion 46. The head portion is linearly aligned with the handle. A bristle arrangement 48 is included and extends outwardly from the head portion of the brush member. The head portion, with the bristle arrangement, is sized for placement through the opening of the container.

Figure 2:
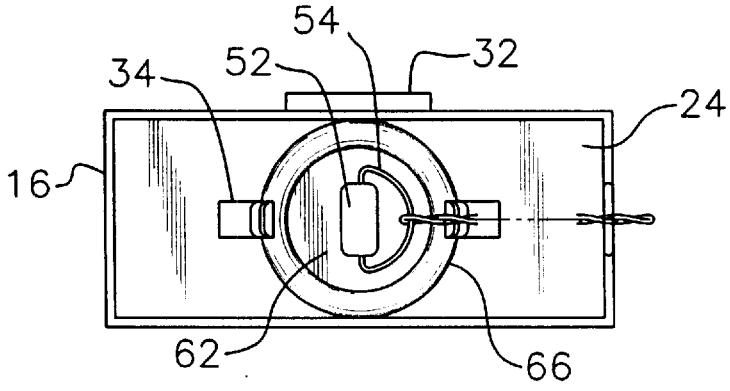
FIG. 2 is a top plan view of the present invention of FIG. 1.

The handle 44 has a handle end 52, as shown in FIG. 2. The handle end has a D-ring 54 that couples with a link chain 56. The link chain may be coupled with the eyelet 30 of the container. The link chain provides a safe way to couple the brush to the container at all times.

Figure 4:
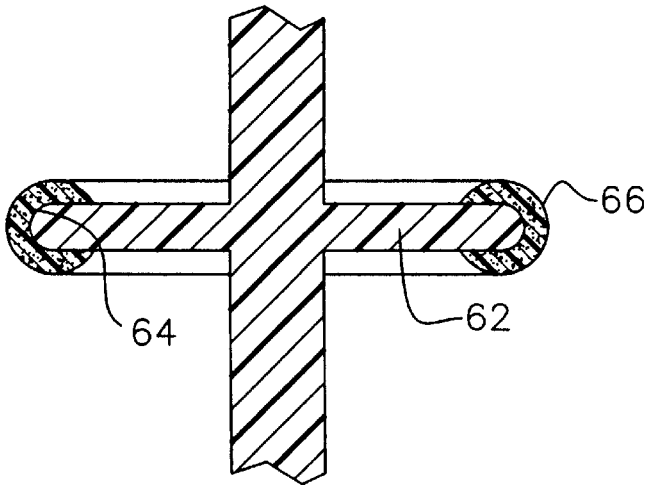
FIG. 4 a cross-sectional view of the disk member and handle connection taken along line 4—4 of FIG. 3.

As best illustrated in FIG. 4, a ridge disk member 62 is formed integral the handle 42. The ridge disk is spaced from the handle end. The disk member projects outwardly from the handle. The disk member has a peripheral end 64.

Lastly, a ring seal 66 is positioned around the disk member 62. The ring seal is made of rubber or a rubberized material The disk member is sized for closing the opening 26 of the container when the brush member 42 is positioned within the container. The ring seal allows the disk member, within the opening, to provide the container with a waterproof seal. The pair of resilient clamps lockingly engage the disk member and hold the brush member in position when the apparatus is not in use.

The present invention club mate apparatus is comprised of a plastic container that is 5 inches high, 3 ½ inches wide and 1 ½ inches deep. The container may be filled with water of a cleaning solution. A firm-bristled brush arrangement is secured to the container with a chain. The brush member fits inside the container. A ring seal, about the size of a quarter is attached to the brush handle so that when the brush is in the container, the disk member makes a waterproof seal. The disk member is locked over the opening with the pair of clamps As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved club mate apparatus for on-site golf club cleaning comprising in combination:

a generally cylindrical container having a bottom wall, a top edge and a peripheral wall therebetween, a top wall being spaced from the top edge, the top wall having an opening therethrough for limiting the accessability to an interior portion of the container;

a pair of resilient clamps being attached to the top wall of the container, each clamp being symmetrically placed near the opening of the container;

a brush member having an elongated handle and a head portion, the head portion being linearly aligned with the handle, a bristle arrangement extending outwardly from the head portion of the brush member, the head portion with the bristle arrangement being sized for placement through the opening of the container;

a ridge disk member being integral the handle and spaced from a handle end, the disk member projecting outwardly from the handle, the disk member having a peripheral end; and a ring seal being positioned around the disk member, the disk member being sized for closing the opening of the container when the brush member being positioned within the container, the ring seal allowing the disk member within the opening to provide the container with a waterproof seal when the a pair of resilient clamps lockingly engage the disk member.

2. A club mate apparatus comprising:

a container having a bottom wall, a top edge and a peripheral wall therebetween, the top edge having an eyelet integral therewith, a top wall having an opening therethrough;

a pair of resilient clamps being attached to the top wall of the container;

a brush member having an elongated handle and a head portion with a bristle arrangement;

a ridge disk member being integral the handle and spaced from a handle end; and a ring seal being positioned around the disk member.

3. A club mate apparatus as set forth in claim 2, wherein each clamp being symmetrically placed near the opening of the container.

4. A club mate apparatus as set forth in claim 2, wherein the head portion being linearly aligned with the handle, the bristle arrangement extending outwardly from the head portion of the brush member, and head portion with the bristle arrangement being sized for placement through the opening of the container.

5. A club mate apparatus as set forth in claim 2, wherein the handle end of the handle having a link chain capable of engaging the eyelet of the top edge of the container for supporting the brush onto the container.

6. A club mate apparatus as set forth in claim 2, wherein the disk member projects outwardly from the handle and has a peripheral end.

7. A club mate apparatus as set forth in claim 2, wherein the disk member being sized for closing the opening of the container when the brush member being positioned within the container, the ring seal allowing the disk member within the opening to provide the container with a waterproof seal when the a pair of resilient clamps lockingly engage the disk member.

* * * * *